US011682506B2

(12) United States Patent
Kim et al.

(10) Patent No.: US 11,682,506 B2
(45) Date of Patent: Jun. 20, 2023

(54) RARE-EARTH PERMANENT MAGNET AND METHOD OF MANUFACTURING THE SAME

(71) Applicants: Hyundai Motor Company, Seoul (KR); Kia Motors Corporation, Seoul (KR); Star Group Ind. Co. LTD, Daegu (KR)

(72) Inventors: Do Hoon Kim, Gyeonggi-do (KR); Hyung Ju Lee, Gyeonggi-do (KR); Jae Hyuk Jang, Seoul (KR); Young Beom Kim, Gyeonggi-do (KR); Dong Hwan Kim, Daegu (KR); Koon Seung Kong, Daegu (KR)

(73) Assignees: Hyundai Motor Company, Seoul (KR); Kia Motors Corporation, Seoul (KR); Star Group Ind. Co. Ltd., Daegu (KR)

( * ) Notice: Subject to any disclaimer, the term of this patent is extended or adjusted under 35 U.S.C. 154(b) by 41 days.

(21) Appl. No.: 16/951,729

(22) Filed: Nov. 18, 2020

(65) Prior Publication Data

US 2021/0319935 A1 Oct. 14, 2021

(30) Foreign Application Priority Data

Apr. 8, 2020 (KR) ..... 10-2020-0042885

(51) Int. Cl.
*H01F 1/057* (2006.01)
*H01F 41/02* (2006.01)
(Continued)

(52) U.S. Cl.
CPC ..... *H01F 1/0577* (2013.01); *B22F 3/10* (2013.01); *B22F 3/24* (2013.01); *B22F 9/04* (2013.01);
(Continued)

(58) Field of Classification Search
None
See application file for complete search history.

(56) References Cited

U.S. PATENT DOCUMENTS

2014/0065004 A1* 3/2014 Li ..... H01F 1/0557 420/83
2018/0211749 A1 7/2018 Lowe et al.
2019/0295754 A1* 9/2019 Kudo ..... H01F 1/0577

FOREIGN PATENT DOCUMENTS

JP H06-030295 B2 4/1994
JP 6419869 B2 11/2018
(Continued)

*Primary Examiner* — Xiaowei Su
(74) *Attorney, Agent, or Firm* — Fox Rothschild LLP

(57) ABSTRACT

Disclosed are a rare-earth permanent magnet having improved magnetic properties and a method of manufacturing the same.

A method of manufacturing a rare-earth permanent magnet may include: preparing a mixed powder including i) a first alloy represented by $R1_aR2_bB_cM_dFe_{bal}$ and ii) a second alloy represented by $R2_bB_cM_dFe_{bal}$ where R1 is one or two or more of La, Ce, and Y; R2 is a rare-earth element except for La, Ce, and Y; and M is a metal element; press-forming and sintering the prepared mixed powder in a magnetic field to prepare a sintered body; and performing a heat treatment based on diffusion temperature conditions of an R1 component and an R2 component contained in the prepared sintered body.

12 Claims, 6 Drawing Sheets

(51) Int. Cl.

| | |
|---|---|
| ***B22F 9/04*** | (2006.01) |
| ***B22F 3/24*** | (2006.01) |
| ***B22F 3/10*** | (2006.01) |
| ***C22C 38/00*** | (2006.01) |

(52) U.S. Cl.
CPC ..... *C22C 38/002* (2013.01); *C22C 38/005* (2013.01); *H01F 41/0266* (2013.01); *B22F 2009/044* (2013.01); *B22F 2301/355* (2013.01); *C22C 2202/02* (2013.01)

(56) References Cited

FOREIGN PATENT DOCUMENTS

| | | | |
|---|---|---|---|
| KR | 2018-0068272 | A | 6/2018 |
| WO | 2016-083269 | A1 | 6/2016 |

* cited by examiner

RARE-EARTH PERMANENT MAGNET AND METHOD OF MANUFACTURING THE SAME

CROSS REFERENCE TO RELATED APPLICATION

The present application claims priority to Korean Patent Application No. 10-2020-0042885, filed Apr. 8, 2020, the entire contents of which is incorporated herein for all purposes by this reference.

TECHNICAL FIELD

The present invention relates to a rare-earth permanent magnet and a method of manufacturing the same. The rare-earth permanent magnet may have improved magnetic properties by including a cerium (Ce)-rich magnetic powder and a cerium (Ce)-poor magnetic powder that substantially does not include cerium (Ce).

BACKGROUND

In general, a rare-earth permanent magnet, which is a magnet having an excellent magnetic force, such as an R—Fe—B sintered magnet (here, "R" represents a rare-earth element such as Nd, Ce, Y, Dy, or Tb, or a rare-earth element combination), may implement an increase in output and reduction in size of a motor. Therefore, the rare-earth permanent magnet has been increasingly used in a variety of fields.

In particular, as a demand for a hybrid or electric vehicle has recently increased, a demand for a rear-earth permanent magnet having a magnetic force improved by 3 to 5 times than that of a ferrite magnet according to the related art is further increased.

Meanwhile, the magnetic properties of a magnetic may be represented by a residual magnetic flux density and a coercive force. For example, the residual magnetic flux density may be determined by a fraction, density, and magnetic orientation degree of a main phase of the rare-earth permanent magnet, and the coercive force may refer to durability of a magnetic force of a magnetic caused by an external magnetic field or heat. The coercive force has a decisive relation with a microstructure of the rare-earth permanent magnet, and is determined by refining of crystal grains or uniform distribution of crystal grain boundary phases.

Therefore, various methods for improving properties of a permanent magnet have been suggested.

Recently, for example, a grain boundary diffusion method capable of improving magnetic properties such as a coercive force by forming a coating layer containing a rare-earth element such as Dy or Tb on a surface of a sintered magnet and then grain boundary diffusing the rare-earth element to the sintered magnet has been mainly used.

Such a grain boundary diffusion method may include forming a coating layer by vapor deposition or forming a coating layer by application depending on a method of forming a coating layer.

For example, the method of forming a coating layer by vapor deposition includes depositing a rare-earth element on a surface of a sintered magnet to form a coating layer and then performing grain boundary diffusion. In this method, a manufacturing cost has been increased due to an increase in costs required for manufacturing equipment and manufacturing processes, and productivity is poor, which leads to difficulty of mass production.

In addition, the method of forming a coating layer by application includes applying a rare-earth element to a surface of a sintered magnet in an oxide or fluoride form and then performing grain boundary diffusion. In this method, a process is relatively simple and productivity is excellent; however, it is difficult to diffuse the rare-earth element into the sintered magnet in large quantities due to diffusion of the rare-earth element by a substitution reaction, which leads to a limitation in increasing the coercive force. In particular, the fluoride or oxide not only inhibits grain boundary diffusion of a pure rare-earth element, but also remains inside the manufactured permanent magnet, which leads to a limitation in increasing the coercive force.

Meanwhile, as described above, an Nd-based rare-earth permanent magnet has been mainly used as a rare-earth permanent magnet manufactured by a single alloy method, but Nd is expensive. Therefore, studies on a rare-earth permanent magnet containing Ce and La, which are about 1/10 the price of Nd, have been conducted.

However, in a case of a Ce-based rare-earth permanent magnet, a main phase (a ratio of R:Fe:B is 2:14:1) can be easily formed, but inherent magnetic properties are lower than those of the Nd-based rare-earth permanent magnet. In a case of a La-based rare-earth permanent magnet, inherent magnetic properties are better than those of the Ce-based rare-earth permanent magnet, but a main phase formation becomes unstable as a content of La is increased.

Therefore, when the Ce-based and La-based rare-earth permanent magnets are manufactured by conventional single alloy methods in the related art, the Ce-based and La-based rare-earth permanent magnets are not cost-effective due to low performance and low cost-effectiveness.

The contents described as the related art have been provided only for assisting in the understanding for the background of the present invention and should not be considered as corresponding to the related art known to those skilled in the art.

SUMMARY

In preferred aspects, provided are a rare-earth permanent magnet having improved magnetic properties and a method of manufacturing the same, for example, by preparing a magnetic powder containing Ce capable of implementing a low cost and easy formation of a main phase, using different the magnetic powders such as a Ce-rich magnetic powder and a magnetic powder that does not include Ce, and mixing the magnetic powder in the Ce-rich and the magnetic powder without Ce.

In an aspect, provided is a method of manufacturing a rare-earth permanent magnet that may include steps of: preparing a mixed powder including i) a first alloy represented by $R1_aR2_bB_cM_dFe_{bal}$ where R1 is one or two or more of La, Ce, and Y; R2 is a rare-earth element except for La, Ce, and Y; M is a metal element; a+b is about 29 to 34 wt %; a/(a+b) is about 30 to 100%; c is about 0.8 to 1.5 wt %; and d is about 0.1 to 5.0 wt %, wt % based on the total weight of the first alloy, and ii) a second alloy represented by $R2_{b'}B_{c'}M_{d'}Fe_{bal}$ where R2 is a rare-earth element except for La, Ce, and Y; M is a metal element; b' is about 29 to 34 wt %; c' is about 0.8 to 1.5 wt %; and d' is about 0.1 to 5.0 wt %, wt % based on the total weight of the total weight of the second alloy; sintering the prepared mixed powder in a magnetic field to prepare a sintered body.

In preferred aspects, the sintered body may be heat treated, preferably where the heat treatment is based on diffusion temperature conditions of an R1 component and an R2 component contained in the prepared sintered body. For instance, such post-sintering heat treatment may comprises distinct cycles of multiple temperature treatments based on diffusion conditions of 1) an R1 component of the sintered body and 2) an R2 component of the sintered body. A cooling period (e.g. 0.1, 0.2, 0.5, 1 minute) may be interposed between successive heat treatment of the sintered body, for instance, where a heat source is removed or withdrawn and/or where the temperature exposed to the sintered body is reduced by 20, 30, 40, 50, 100, 150, 200° C. or more. In multiple heat cycles of the sintered body, the temperature of a first heat treatment or cycle of sintered body may be different than a second heat treatment or cycle of the sintered body, e.g. such first and second heat cycles may differ by 5, 10, 20, 30, 40, 50, 60, 70, 80, 90 or 100° C. or more.

A term "diffusion" as used herein refers to a process for or during producing an alloy, and in the diffusion process, certain components (e.g., metal elements or atoms) among different alloy components transfer, move, or diffuse, thereby changing chemical composition of a part of the alloy regions.

A term "R1 component" as used herein refers to all the R1 (e.g., total elements selected from one or two or more of La, Ce, and Y) included in the sintered body after the sintering process, and those elements are from the first alloy (optionally, and/or the second alloy). Likewise, a term "R2 component" refers to all the R2 (e.g., total elements selected from the rare-earth element except for La, Ce, and Y) included in the sintered body after the sintering process, and those elements are from the first alloy and the second alloy.

The diffusion temperature of an alloy may be determined based on the chemical composition of the alloy, e.g., contents ratio between R1 component and R1 component in the alloy composition. For example, a range of the diffusion temperature of the R1 components is from about 550° C. to about 750° C., which is less than a range of the diffusion temperature of the R2 components, from about 750° C. to about 950° C. In certain embodiments, a range of the diffusion temperature of the alloy may range in relation to the ratio of the contents thereof.

Preferably, the first alloy may be Ce-rich.

Preferably, the second alloy may be Ce-poor, or does not include Ce.

In the first alloy, R1 may include Ce alone or at least about 70 wt % of Ce based on the total weight of the first alloy.

In the first alloy or the second alloy, M may include one or two or more elements selected from the group consisting of Co, Ni, Cu, Zn, Al, Ga, Ti, V, Cr, Mn, Zr, Nb, Mo, Hf, Ta, and W.

The mixed powder may be prepared by the steps including: preparing, respectively, a first strip by dissolving and then cooling the first alloy and a second strip by dissolving and then cooling the second alloy; preparing, respectively, a first treated powder by hydrogenating, dehydrogenating, and jet-mill-treating the prepared first strip and a second treated powder by hydrogenating, dehydrogenating, and jet-mill-treating the second strip; and preparing the mixed powder including, e.g., by mixing, the prepared first treated powder and second treated powder.

The mixed powder may include the first treated powder and the second treated powder at a weight ratio of about 50 to 90:about 50 to 10.

Alternatively, the mixed powder may be prepared by the steps: preparing, respectively, a first strip by dissolving and then cooling the first alloy and a second strip by dissolving and then cooling the second alloy; preparing a mixed strip including, by mixing, the first strip and the second strip; and preparing a mixed powder by hydrogenating, dehydrogenating, and jet-mill-treating the prepared mixed strip.

The mixed powder may include the first strip and the second strip at a weight ratio of about 50 to 90:about 50 to 10.

The heat treatment may be performed by the steps including: performing a primary heat treatment at a diffusion temperature of the R1 component contained in the prepared sintered body; performing a secondary heat treatment at a diffusion temperature of the R2 component contained in the sintered body subjected to the primary heat treatment; performing a tertiary heat treatment for arranging atomic lattices of components constituting the sintered body subjected to the secondary heat treatment.

The primary heat treatment may be performed in a temperature range of about 550 to 750° C., the secondary heat treatment may be performed in a temperature range of about 750 to 950° C., and the tertiary heat treatment may be performed in a temperature range of about 450 to 550° C.

Each of the primary heat treatment step, the secondary heat treatment step, and the tertiary heat treatment step may be performed for about 0.1 to 20 hours.

The heat treatment may be performed by the steps further including: cooling the sintered body subjected to the primary heat treatment after the primary heat treatment; cooling the sintered body subjected to the secondary heat treatment after the secondary heat treatment; and cooling the sintered body subjected to the tertiary heat treatment after the tertiary heat treatment.

Each of the primary cooling step, the secondary cooling step, and the tertiary cooling step may be performed at a cooling rate of about 2 to 20° C./s.

In an aspect, provided is a method of manufacturing a rare-earth permanent magnet that may include steps of: preparing a mixed powder including i) a first alloy represented by $R1_aR2_bB_cM_dFe_{bal}$ where R1 is one or two or more of La, Ce, and Y; R2 is a rare-earth element except for La, Ce, and Y; M is a metal element; a+b is about 29 to 34 wt %; a/(a+b) is about 30 to 100%; c is about 0.8 to 1.5 wt %; and d is about 0.1 to 5.0 wt %, wt % based on the total weight of the first alloy, and ii) a second alloy represented by $R1_{a'}R2_{b'}B_{c'}M_{d'}Fe_{bal}$ where R1 is one or two or more of La, Ce, and Y; R2 is a rare-earth element except for La, Ce, and Y; M is a metal element; a'+b' is about 29 to 34 wt %; a'/(a'+b') is about 0 to 30% (excluding 0%); c' is 0.8 to 1.5 wt %; and d' is about 0.1 to 5.0 wt %, wt % based on the total weight of the second alloy; press-forming and sintering the prepared mixed powder in a magnetic field to prepare a sintered body; and performing a heat treatment based on diffusion temperature conditions of an R1 component and an R2 component contained in the prepared sintered body.

Preferably, the first alloy may be Ce-rich.

Preferably, the second alloy may be Ce-poor, or substantially does not include Ce.

In the first alloy, R1 may include Ce alone or at least about 70 wt % of Ce based on the total weight of the first alloy.

In the first alloy or the second alloy, M may include one or two or more elements selected from the group consisting of Co, Ni, Cu, Zn, Al, Ga, Ti, V, Cr, Mn, Zr, Nb, Mo, Hf, Ta, and W.

The mixed powder may be prepared by the steps including: preparing, respectively, a first strip by dissolving and then cooling the first alloy and a second strip by dissolving and then cooling the second alloy; preparing, respectively, a first treated powder by hydrogenating, dehydrogenating, and jet-mill-treating the prepared first strip and a second treated powder by hydrogenating, dehydrogenating, and jet-mill-treating the second strip; and preparing the mixed powder including, e.g., by mixing, the prepared first treated powder and second treated powder.

The mixed powder may include the first treated powder and the second treated powder at a weight ratio of about 50 to 90:about 50 to 10.

Alternatively, the mixed powder may be prepared by the steps: preparing, respectively, a first strip by dissolving and then cooling the first alloy and a second strip by dissolving and then cooling the second alloy; preparing a mixed strip including, by mixing, the first strip and the second strip; and preparing a mixed powder by hydrogenating, dehydrogenating, and jet-mill-treating the prepared mixed strip.

The mixed powder may include the first strip and the second strip at a weight ratio of about 50 to 90:about 50 to 10.

The heat treatment may be performed by the steps including: performing a primary heat treatment at a diffusion temperature of the R1 component contained in the prepared sintered body; performing a secondary heat treatment at a diffusion temperature of the R2 component contained in the sintered body subjected to the primary heat treatment; performing a tertiary heat treatment for arranging atomic lattices of components constituting the sintered body subjected to the secondary heat treatment.

The primary heat treatment may be performed in a temperature range of about 550 to 750° C., the secondary heat treatment may be performed in a temperature range of about 750 to 950° C., and the tertiary heat treatment may be performed in a temperature range of about 450 to 550° C.

Each of the primary heat treatment step, the secondary heat treatment step, and the tertiary heat treatment step may be performed for about 0.1 to 20 hours.

The heat treatment may be performed by the steps further including: cooling the sintered body subjected to the primary heat treatment after the primary heat treatment; cooling the sintered body subjected to the secondary heat treatment after the secondary heat treatment; and cooling the sintered body subjected to the tertiary heat treatment after the tertiary heat treatment.

Each of the primary cooling step, the secondary cooling step, and the tertiary cooling step may be performed at a cooling rate of about 2 to 20° C./s.

In another aspect, provided a rare-earth permanent magnet which is represented as an R1-R2-B-M-Fe-based rare-earth permanent magnet, R1 being one or two or more of La, Ce, and Y, R2 being a rare-earth element except for La, Ce, and Y, and M being a metal element. The rare-earth permanent magnet may include: a main phase represented by $(R1,R2)_2BFe_{14}$; and a first auxiliary phase not including Ce or substantially not including Ce and a second auxiliary phase including Ce, the first auxiliary phase and the second auxiliary phase being formed at grain boundaries of the main phase.

Preferably, a first auxiliary phase may be Ce-poor, and a second auxiliary phase may be Ce-rich.

The first auxiliary phase in the Ce-less state may be represented by $R1_eR2_fFe_{bal}$ where e<f, and e+f>about 34 wt %, and the second auxiliary phase in the Ce-rich state may be represented by $R1_eR2_fFe_{bal}$ where e>f, and e+f>about 34 wt %.

The main phase, the first auxiliary phase, and the second auxiliary phase may be formed so that R1 includes Ce alone or at least about 70 wt % of Ce.

Other aspect of the invention are disclosed infra.

DETAILED DESCRIPTION

Hereinafter, embodiments of the present invention will be described in more detail with reference to the accompanying drawings. However, the present invention is not limited to the disclosed embodiments below, but may be implemented in various different forms. The embodiments are provided to only complete the present invention and to allow those skilled in the art to fully understand the category of the present invention.

Unless otherwise indicated, all numbers, values, and/or expressions referring to quantities of ingredients, reaction conditions, polymer compositions, and formulations used herein are to be understood as modified in all instances by the term "about" as such numbers are inherently approximations that are reflective of, among other things, the various uncertainties of measurement encountered in obtaining such values.

Further, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

In the present specification, when a range is described for a variable, it will be understood that the variable includes all values including the end points described within the stated range. For example, the range of "5 to 10" will be understood to include any subranges, such as 6 to 10, 7 to 10, 6 to 9, 7 to 9, and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Also, for example, the range of "10% to 30%" will be understood to include subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

Figure 1A:
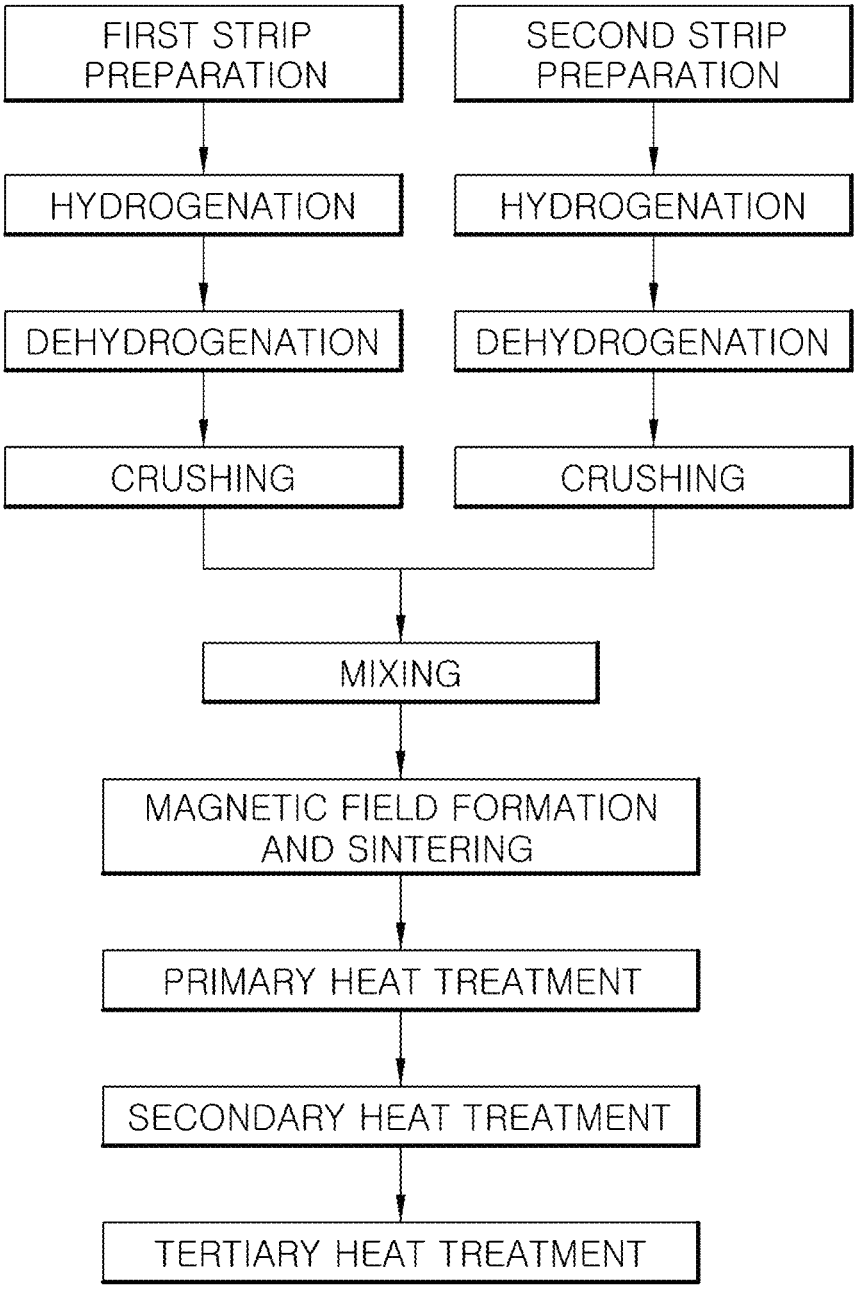
FIGS. 1A and 1B show exemplary methods of manufacturing a rare-earth permanent magnet according to exemplary embodiments of the present invention.
Figure 1B:
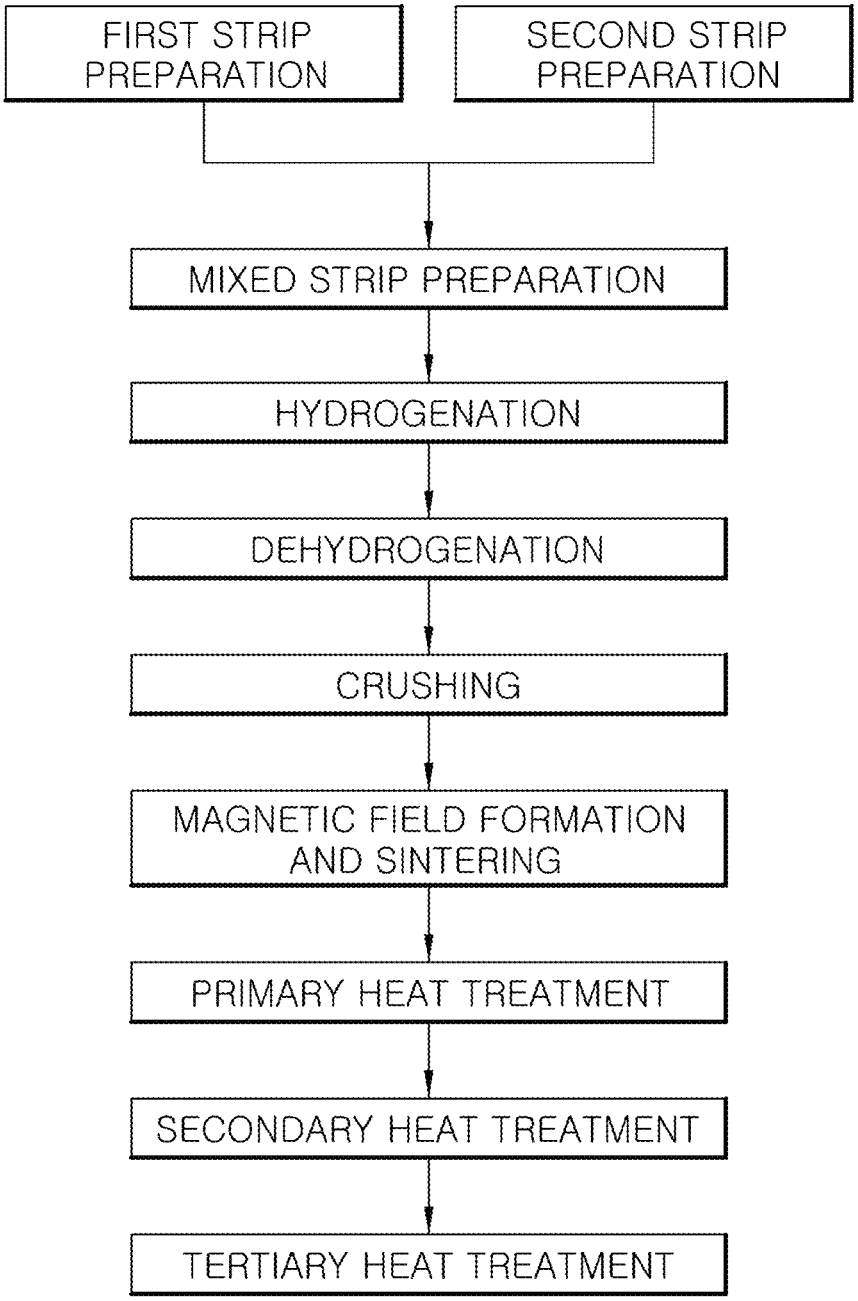

FIGS. 1A and 1B show exemplary methods of manufacturing an exemplary rare-earth permanent magnet according to exemplary embodiments of the present invention.

As illustrated in the drawings, the method of manufacturing a rare-earth permanent magnet may include: a mixed powder preparation step of preparing a mixed powder including a first alloy in a Ce-rich state and a second alloy in a Ce-poor state; a formation step of press-forming and sintering the prepared mixed powder in a magnetic field to prepare a sintered body; and a heat treatment step of performing a heat treatment, e.g., by classifying a heat treatment temperature, based on diffusion temperature conditions of an R1 component and an R2 component contained in the prepared sintered body.

The first alloy used may be a Ce-rich state. The first alloy is represented by $R1_aR2_bB_cM_dFe_{bal}$ where R1 is one or two or more of La, Ce, and Y, R2 is a rare-earth element except for La, Ce, and Y, M is a metal element, a+b is about 29 to 34 wt %, a/(a+b) is about 30 to 100%, c is about 0.8 to 1.5 wt %, and d is about 0.1 to 5.0 wt %, wt % are based on the total weight of the first alloy.

The first alloy may be formed so that R1 includes Ce alone or at least about 70 wt % of Ce. When R1 contains at least about 70 wt % of Ce, Ce may be replaced with La or Y. Preferably, in a range of about 25 to 30 wt % of a total weight of Ce, Ce may be replaced with La or Y.

For example, the first alloy may be prepared with 12% Ce-19% Nd-1% B-2% M-Bal. % Fe. Preferably, the first alloy may be prepared with 12% Ce-17% Nd-2% Ho-1% B-1% Co-0.15% Cu-0.75% Al-0.35% Nb-0.35% Ga-65.4% Fe by using Ce for R1, Pr—Nd and Ho for R2, and Co, Cu, Al, Nb, and Ga for M.

The second alloy may be in a Ce-poor state, or substantially does not include Ce, which may be prepared by completely excluding elements corresponding to R1 of the first alloy. In addition, the second alloy is represented by $R2_bB_cM_dFe_{bal}$ where R2 is a rare-earth element except for La, Ce, and Y, M is a metal element, b' is about 29 to 34 wt %, c' is about 0.8 to 1.5 wt %, and d' is about 0.1 to 5.0 wt %, wt % are based on the total weight of the second alloy.

For example, the second alloy may be prepared with 31% Nd-1% B-2% M-Bal. % Fe. Preferably, the second alloy may be prepared with 30% Nd-1% Ho-1% B-1% Co-0.15% Cu-0.25% Al-0.35% Nb-0.15% Ga-66.1% Fe by excluding R1 and using Pr—Nd and Ho for R2, and Co, Cu, Al, Nb, and Ga for M.

In addition, the second alloy may be in a Ce-less state and may be prepared by changing the first alloy and a ratio of a'/(a'+b') while including R1 of the first alloy. Therefore, the second alloy is represented by $R1_aR2_bB_cM_dFe_{bal}$ where R1 is one or two or more of La, Ce, and Y, R2 is a rare-earth element except for La, Ce, and Y, M is a metal element, a'+b' is about 29 to 34 wt %, a'/(a'+b') is about 0 to 30% (excluding 0%), c' is about 0.8 to 1.5 wt %, and d' is about 0.1 to 5.0 wt %, wt % are based on the total weight of the second alloy.

For example, the second alloy may be prepared with 6% Ce-25% Nd-1% B-2% M-Bal. % Fe. Preferably, the second alloy may be prepared with 6% Ce-22% Nd-3% Ho-1% B-1% Co-0.15% Cu-0.5% Al-0.35% Nb-0.25% Ga-65.75% Fe by using Ce for R1, Pr—Nd and Ho for R2, and Co, Cu, Al, Nb, and Ga for M.

In addition, M may suitably include one or two or more elements selected from the group consisting of Co, Ni, Cu, Zn, Al, Ga, Ti, V, Cr, Mn, Zr, Nb, Mo, Hf, Ta, and W.

For example, the first alloy and the second alloy may be prepared as shown in Table 1-1. In this case, magnetic properties of the first alloy and the second alloy prepared as shown in Table 1-1 are shown in Table 1-2.

TABLE 1-1

| Classification | | Re | | | | | | TM | | | | | | |
|---|---|---|---|---|---|---|---|---|---|---|---|---|---|---|
| | | Pr—Nd | La | Ce | Ho | total Re | B | Co | Cu | Al | Nd | Ga | total TM | Fe |
| Second alloy | Excluding Ce | 30.0 | — | — | 1.0 | 31.0 | 1.00 | 1.00 | 0.15 | 0.25 | 0.35 | 0.15 | 1.90 | 66.10 |
| Second alloy | Including Ce | 24.0 | — | 6.0 | 1.0 | 31.0 | 1.00 | 1.00 | 0.15 | 0.50 | 0.35 | 0.25 | 2.25 | 65.75 |
| Second alloy | Including Ce | 22.0 | — | 6.0 | 3.0 | 31.0 | 1.00 | 1.00 | 0.15 | 0.50 | 0.35 | 0.25 | 2.25 | 65.75 |
| First alloy | — | 17.0 | — | 12.0 | 2.0 | 31.0 | 1.00 | 1.00 | 0.15 | 0.75 | 0.35 | 0.35 | 2.60 | 65.40 |
| First alloy | — | 13.0 | — | 15.0 | 3.0 | 31.0 | 1.00 | 1.00 | 0.15 | 0.75 | 0.35 | 0.35 | 2.60 | 65.40 |
| First alloy | — | 13.0 | 5.0 | 10.0 | 3.0 | 31.0 | 1.00 | 1.00 | 0.15 | 0.75 | 0.35 | 0.35 | 2.60 | 65.40 |

TABLE 1-2

| Classification | | Magnetic properties | | |
|---|---|---|---|---|
| | | Density | Br | Hcj |
| Second alloy | Excluding Ce | 7.52 | 13.75 | 16.44 |
| Second alloy | Including Ce | 7.57 | 13.01 | 13.06 |
| Second alloy | Including Ce | 7.57 | 12.56 | 14.99 |
| First alloy | — | 7.58 | 11.70 | 10.51 |
| First alloy | — | 7.59 | 11.09 | 7.25 |
| First alloy | — | 7.52 | 11.44 | 7.47 |

The mixed powder preparation step is a step of preparing a mixed powder by using the first alloy and the second alloy. In this case, the mixed powder preparation step may be performed in two ways.

First, as illustrated in FIG. 1A, the mixed powder preparation step may include: a strip preparation step of preparing, respectively, a first strip by dissolving and then cooling the first alloy and a second strip by dissolving and then cooling the second alloy; preparing, respectively, a first treated powder by hydrogenating, dehydrogenating, and jet-mill-treating (crushing) the prepared first strip and a second treated powder by hydrogenating, dehydrogenating, and jet-mill-treating (crushing) the prepared second strip; and a mixed powder preparation step of preparing a mixed powder including, e.g., by mixing, the prepared first treated powder and second treated powder.

For example, in preparing the mixed powder as described above, a first strip and a second strip may be prepared with respect to the prepared first alloy and second alloy, respectively, a first treated powder and a second treated powder are prepared by separately hydrogenating, dehydrogenating, and jet-mill-treating the first strip and the second strip, and then the first treated powder and the second treated powder are mixed with each other.

Preferably, the preparation, hydrogenation, dehydrogenation, and jet mill treatment of each of the first ship and the second strip may be performed through preparation, hydrogenation, dehydrogenation, and jet mill treatment processes that are applied to a general method of manufacturing a rare-earth permanent magnet.

However, it is preferable that in the mixed powder preparation step, the first treated powder (Ce-rich) and the second treated powder (Ce-less) may be mixed with each other in a weight ratio of about 50 to 90:50 to 10.

When a mixed amount of the second treated powder (Ce-less) is less than the predetermined range above, a coercive force may be reduced as compared to when the same composition is produced by a single alloy method.

On the other hand, when the mixed amount of the second treated powder (Ce-less) is greater than the predetermined range above, a synergistic effect of the coercive force may not be sufficient as compared to when the same composition is produced by a single alloy method.

The reason is that when the mixed amount of the second treated powder (Ce-less) is greater than about 50 wt %, a $Nd_2Fe_{17}$ phase, which is a soft magnetic phase that is disadvantageous for hard magnetic properties, may be formed, whereas, when a mixed amount of the first treated powder (Ce-rich) is greater than about 50 wt %, a soft magnetic phase may not be formed.

In addition, when the mixed amount of the first treated powder (Ce-rich) is greater than about 50 wt %, when a tertiary heat treatment step to be described below is performed, a Ce-less (Nd-rich) phase and a Ce-rich phase may be uniformly diffused to grain boundaries, and thus, a magnetization reversal suppression effect may be maximized through magnetic isolation, thereby improving the hard magnetic properties.

Alternatively, in preparing the mixed powder, as illustrated in FIG. 1B, the mixed powder preparation step may include: a strip preparation step of preparing, respectively, a first strip by dissolving and then cooling the first alloy and a second strip by dissolving and then cooling the second alloy; a mixed strip preparation step of preparing a mixed strip including, e.g., by mixing, the first strip and the second strip; and a mixed powder preparation step of preparing a mixed powder by hydrogenating, dehydrogenating, and jet-mill-treating the prepared mixed strip.

Preferably, a first strip and a second strip may be prepared with respect to the prepared first alloy and second alloy, respectively, a mixed strip may be prepared by mixing the prepared first strip and second strip with each other, and a mixed powder may be prepared by hydrogenating, dehydrogenating, and jet-mill-treating the prepared mixed strip.

The preparation, hydrogenation, dehydrogenation, and jet mill treatment of the mixed strip may be performed through preparation, hydrogenation, dehydrogenation, and jet mill treatment processes that are applied to a general method of manufacturing a rare-earth permanent magnet.

In the mixed powder preparation step, the first strip and the second strip may be mixed with each other in a weight ratio of about 50 to 90:about 50 to 10.

As described above, the step of mixing the first strip and the second strip with each other may be performed in any step among various steps in the mixed powder preparation step.

Meanwhile, the formation step is a step of press-forming and sintering the prepared mixed powder in a magnetic field to prepare a sintered body, and is performed through a press-formation step and a sintering step that are applied to a general method of manufacturing a rare-earth permanent magnet.

In addition, the heat treatment step is performed, e.g., by classifying a heat treatment temperature based on diffusion temperature conditions of an R1 component and an R2 component contained in the prepared sintered body.

For example, the heat treatment step may include: a primary heat treatment step of performing a primary heat treatment at a diffusion temperature of the R1 component contained in the prepared sintered body; a secondary heat treatment step of performing a secondary heat treatment at a diffusion temperature of the R2 component contained in the sintered body subjected to the primary heat treatment; and a tertiary heat treatment step of performing a tertiary heat treatment for arranging atomic lattices of components constituting the sintered body subjected to the secondary heat treatment.

The primary heat treatment step may be performed in a temperature range of about 550 to 750° C., the secondary heat treatment step may be performed in a temperature range of 750 to about 950° C., and the tertiary heat treatment step may be performed in a temperature range of about 450 to 550° C.

The reason why the heat treatment may be performed by being divided into three steps in the present embodiment is because a first auxiliary phase in a Ce-less state and a second auxiliary phase in a Ce-rich state may be formed at grain boundaries of a main phase by uniformly diffusing the R1 component and the R2 component and arranging the atomic lattices, and a coercive force and a residual magnetic flux density may be increased by the first auxiliary phase and the second auxiliary phase formed as described above.

In addition, each of the primary heat treatment step, the secondary heat treatment step, and the tertiary heat treatment step may be preferably performed for about 0.1 to 20 hours.

A primary cooling step of cooling the sintered body subjected to the primary heat treatment may be performed after the primary heat treatment step, a secondary cooling step of cooling the sintered body subjected to the secondary heat treatment may be performed after the secondary heat treatment step, and a tertiary cooling step of cooling the sintered body subjected to the tertiary heat treatment may be performed after the tertiary heat treatment step.

Each of the primary cooling step, the secondary cooling step, and the tertiary cooling step may be performed at a cooling rate of about 2 to 20° C./s to cool the sintered body up to room temperature, and then a following step may be performed.

The rare-earth permanent magnet manufactured by the manufacturing method described above is represented as an R1-R2-B-M-Fe-based rare-earth permanent magnet, R1 being one or two or more of La, Ce, and Y, R2 being a rare-earth element except for La, Ce, and Y, and M being a metal element.

In particular, the rare-earth permanent magnet may include a main phase including a rare-earth element represented by $(R1,R2)_2BFe_{14}$; and a first auxiliary phase in a Ce-poor state or substantially not including Ce and a second auxiliary phase in a Ce-rich state, the first auxiliary phase and the second auxiliary phase being formed at grain boundaries of the main phase.

In this case, the first auxiliary phase in the Ce-less (Nd-rich) state is represented by $R1_eR2_fFe_{bal}$ where R1 is one or two or more of La, Ce, and Y, R2 is a rare-earth element except for La, Ce, and Y, e<f, and e+f>34 wt %.

In addition, the second auxiliary phase in the Ce-rich state is represented by $R1_eR2_fFe_{bal}$ where R1 is one or two or more of La, Ce, and Y, R2 is a rare-earth element except for La, Ce, and Y, e>f, and e+f>34 wt %.

In addition, the main phase, the first auxiliary phase, and the second auxiliary phase may be formed so that R1 may include Ce alone or at least about 70 wt % of Ce.

EXAMPLE

The rare-earth permanent magnet manufactured as described above will be described with reference to examples and comparative examples.

First, rare-earth permanent magnets were manufactured according to examples of the present invention by using a first alloy in a Ce-rich state and a second alloy in a Ce-poor state, but each sample was prepared while changing a Ce content in the first alloy. A coercive force of each sample was measured and the results are shown in Table 2.

Figure 3A:
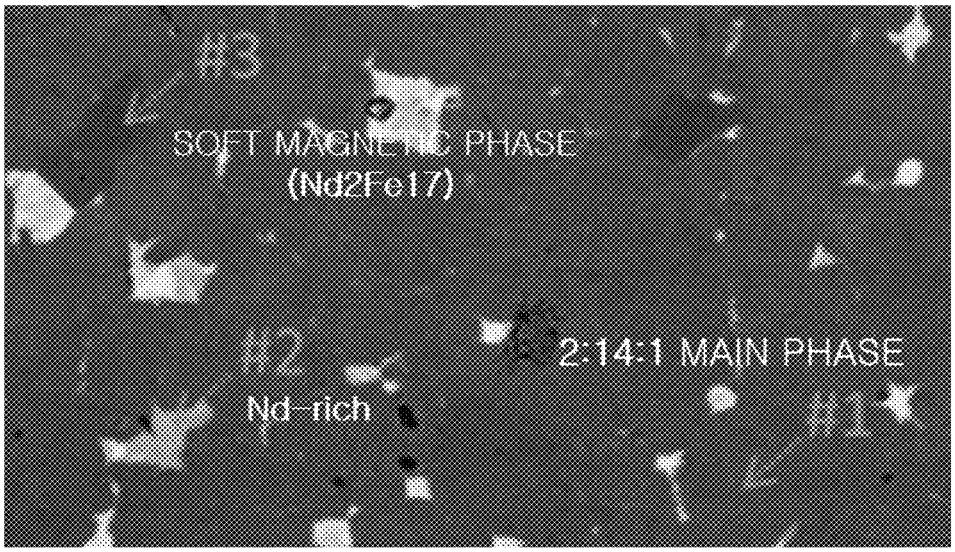
FIGS. 3A and 3B show microstructures of samples prepared according to a change in a Ce content in exemplary first alloys according to exemplary embodiments of the present invention.
Figure 3B:
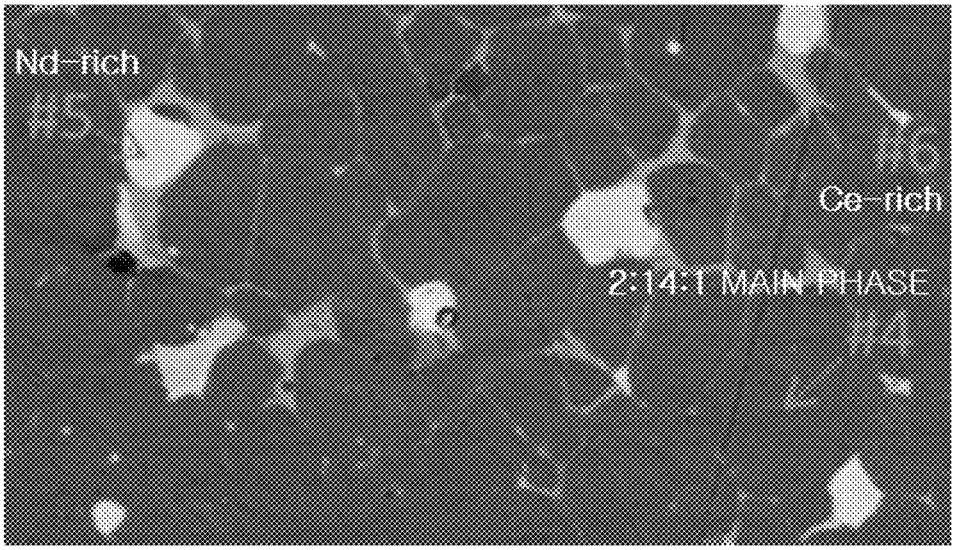

In addition, microstructures of a sample (A) in which the Ce content in the first alloy is 20 wt % and a sample (B) in which the Ce content in the first alloy is 80 wt % were observed, and the results are shown in FIGS. 3A and 3B, respectively.

Figure 2:
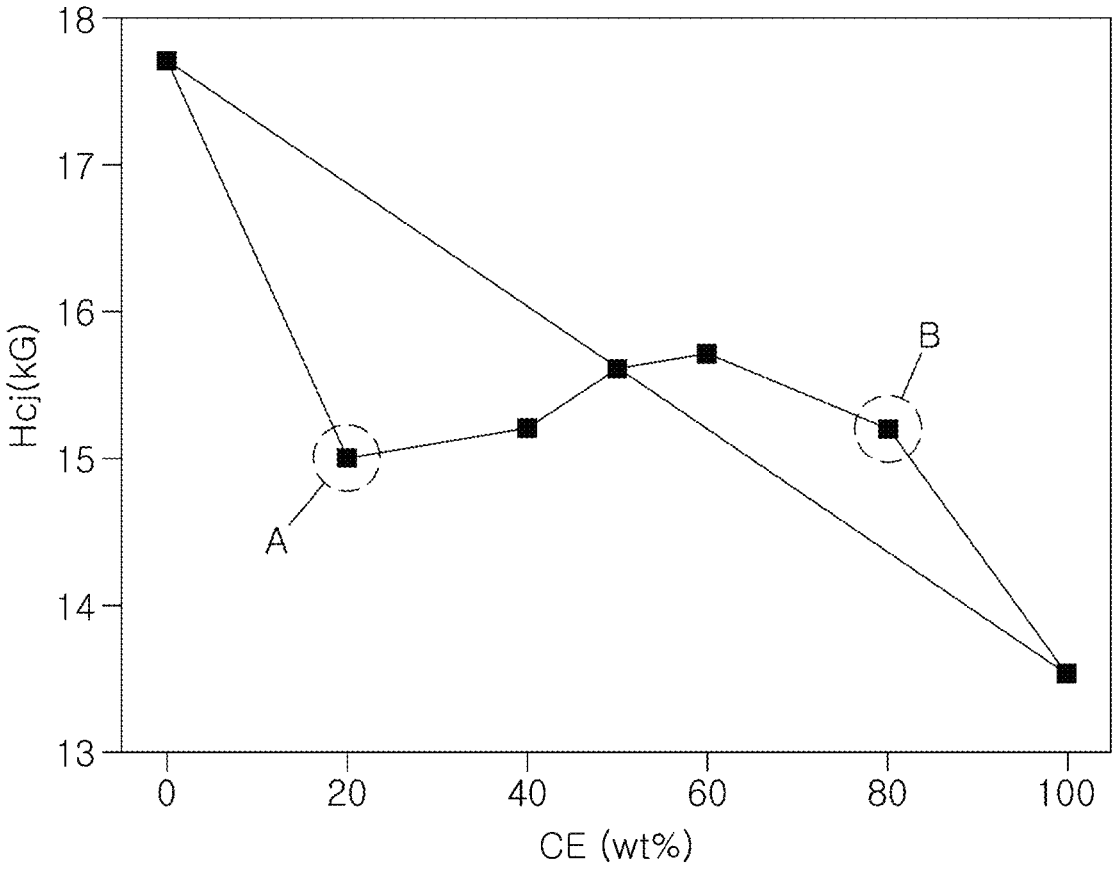
FIG. 2 shows a change in a coercive force according to a change in a Ce content in an exemplary first alloy according to an exemplary embodiment of the present invention.

FIG. 2 is a graph showing a change in the coercive force according to a change in the Ce content in the first alloy, and FIGS. 3A and 3B are photographs showing the microstructures of the samples prepared according to the change in the Ce content in the first alloy. In this case, FIG. 3A is the photograph showing the microstructure of the sample A of FIG. 2, and FIG. 3B is the photograph showing the microstructure of the sample B of FIG. 2. In addition, results of analyzing components of phases formed in FIGS. 3A and 3B are shown in Table 2.

TABLE 2

| | | Fe(at %) | Nd(at %) | Ce(at %) | Note |
|---|---|---|---|---|---|
| Worst | | | | | |
| #1 | $(Nd, Ce)_2Fe_{14}B$ | 68.61 | 9.72 | 0.93 | Main phase (hard magnetic property) |
| #2 | (Nd, Ce)rich | 24.22 | 24.06 | 2.56 | Non-magnetic property |
| #3 | $(Nd, Ce)_2Fe_{17}$ | 81.63 | 7.4 | 1.44 | Soft magnetic property |
| Best | | | | | |
| #4 | $(Nd, Ce)_2Fe_{14}B$ | 61.76 | 6.39 | 3.11 | Main phase (hard magnetic property) |
| #5 | (Nd, Ce)rich | 30.87 | 15.71 | 3.97 | Non-magnetic property |
| #6 | (Nd, Ce)rich | 36.42 | 4.76 | 14.27 | Non-magnetic property |

A conventional NdFeB magnet in the related art was composed of a main phase and a grain boundary phase. In this case, the main phase was formed of $Nd_2Fe_{14}B$, and the grain boundary phase was formed into a Ce-less phase.

On the other hand, a NdCeFeB magnet, which was a resultant of the present invention, was also composed of a main phase and a grain boundary phase. In this case, the main phase was formed of $(Nd,Ce)_2Fe_{14}B$, and the grain boundary phase included both a Nd-rich (Ce-less) phase and a Ce-rich phase. Here, it does not mean that Ce and Nd were absent in the Nd-rich (Ce-poor) phase and the Ce-rich phase, respectively, and it can be confirmed that Nd was distributed in the Ce-less phase in a greater amount than Ce or Ce was distributed in the Ce-rich phase in a larger amount than Nd. It is preferable that #2 and #5 are classified as the Nd-rich (Ce-poor) phase (Ce is significantly less than Nd), and #6 is classified as the Ce-rich phase (Nd is significantly less than Ce).

As illustrated in FIG. 2, the coercive force was increased in a range in which the Ce content in the first alloy in the Ce-rich state was 50 wt % or greater.

In addition, in the case of the sample A (Worst Case) as illustrated in FIG. 3A, (Nd,Ce)rich phases were locally distributed mainly around a triple grain junction, and a $(Nd,Ce)_2Fe_{17}$ phase, which was a soft magnetic phase, was observed. It can be determined from the above causes that the coercive force was reduced.

On the other hand, in the case of the sample B (Best Case) as illustrated in FIG. 3B, it could be confirmed that a network between a plurality of grains was formed by distribution of the (Nd,Ce)rich phases, and the (Nd,Ce)rich phases were relatively uniformly distributed along the grains.

In addition, it could be confirmed that there was a shade difference between the (Nd,Ce)rich phases, and, as a result of an EDX analysis, the Ce content in the phases forming the network was relatively greater than the Nd content. The reason is determined that Ce was transformed into a liquid phase at a temperature less than that of Nd in the sintering step, and wetting of Ce was more smoothly performed than that of Nd. Therefore, it can be seen that a distribution difference between the (Nd,Ce)rich phases occurred due to a mixing ratio of a Ce-poor powder to a Ce-rich powder.

The distributed (Nd,Ce)rich phases magnetically isolated a $Re_2Fe_{14}B$ phase to increase magnetic exchange energy. This is because a magnetization reversal suppression effect was exhibited according to an isolation effect of a 2:14:1 phase, which was a main phase.

As a result of the above analysis, it could be concluded that a coercive force increase effect was highest in a range in which the Ce content in the first alloy in the Ce-rich state was 50 wt % or greater, in particular, in a range of 75 to 85 wt %.

Next, magnetic properties and a microstructure according to a mixing ratio of the first alloy in the Ce-rich state to the second alloy in the Ce-poor state in which Ce was not contained were investigated.

In this case, the mixing ratio of the first alloy to the second alloy was changed as shown in Table 3-1, and measured values of the residual magnetic flux density and the coercive force according to the change were shown in Table 3-2.

Meanwhile, in order to compare a sample in which the first alloy and the second alloy are mixed with each other according to the example of the present invention and a sample formed by a single alloy method, a residual magnetic flux density and a coercive force of each sample having the same composition and prepared by the single alloy method were measured. The results are shown in Table 3-2.

Figure 4A:
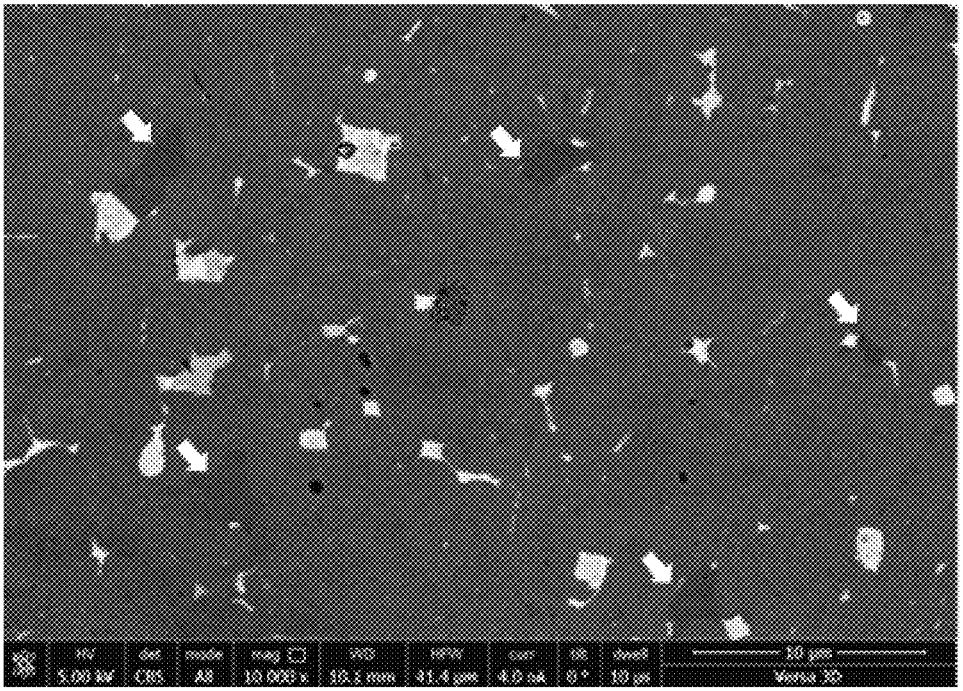
FIGS. 4A and 4B show microstructures of samples prepared according to an exemplary mixing ratio of an exemplary first alloy to an exemplary second alloy, respectively.
Figure 4B:
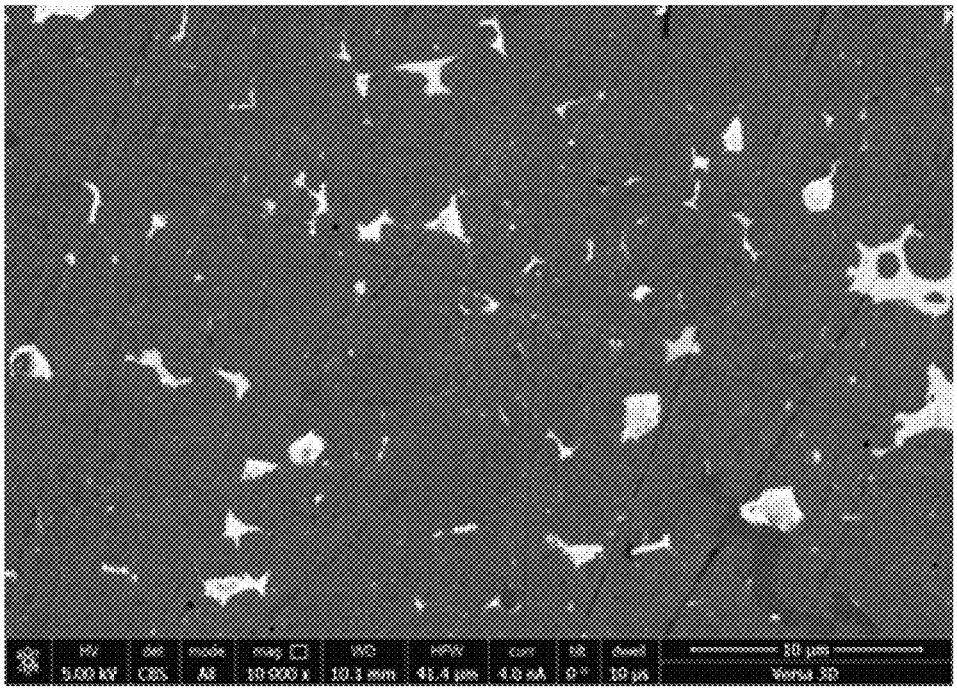

In addition, microstructure photographs of the sample 1-3 and the sample 1-7 of Table 3-1 were shown in FIGS. 4A and 4B, respectively.

TABLE 3-1

| Sample condition | Mixing ratio: First alloy (16% Nd + 12% Ce) | Mixing ratio: Second alloy (28% Nd + 0% Ce) | Content of rare-earth element (total rare-earth element: 28%): Nd | Content of rare-earth element (total rare-earth element: 28%): Ce |
|---|---|---|---|---|
| 1-1 | 0 | 100 | 28 | 0 |
| 1-2 | 10 | 90 | 26.8 | 1.2 |
| 1-3 | 20 | 80 | 25.6 | 2.4 |
| 1-4 | 40 | 60 | 23.2 | 4.8 |
| 1-5 | 50 | 50 | 22 | 6 |
| 1-6 | 60 | 40 | 20.8 | 7.2 |
| 1-7 | 80 | 20 | 18.4 | 9.6 |
| 1-8 | 90 | 10 | 17.2 | 10.8 |
| 1-9 | 100 | 0 | 16 | 12 |

As shown in Table 3-2, it could be confirmed that the coercive force was increased as compared to the single alloy method in a range in which the Ce content in the first alloy in the Ce-rich state is 50 wt % or greater.

On the other hand, it could be confirmed that the coercive force was reduced as compared to the single alloy method in a range in which the Ce content in the first alloy in the Ce-rich state is less than 50 wt %.

In addition, as illustrated in FIG. 4A, it could be confirmed that a $Nd_2Fe_{17}$ phase (indicated by the arrow), which is a soft magnetic phase, was formed in a sample in which the Ce content in the first alloy in the Ce-rich state was 20 wt %. On the other hand, as illustrated in FIG. 4B, it could be confirmed that a soft magnetic phase was not formed in a sample in which the Ce content in the first alloy in the Ce-rich state was 80 wt %.

Next, magnetic properties and microstructures of a sample manufactured by the single alloy method according to the related art and a sample according to the present invention were investigated.

In this case, a condition of each sample and measured values of a residual magnetic flux density and a coercive force of each sample were shown in Table 4.

Figure 5A:
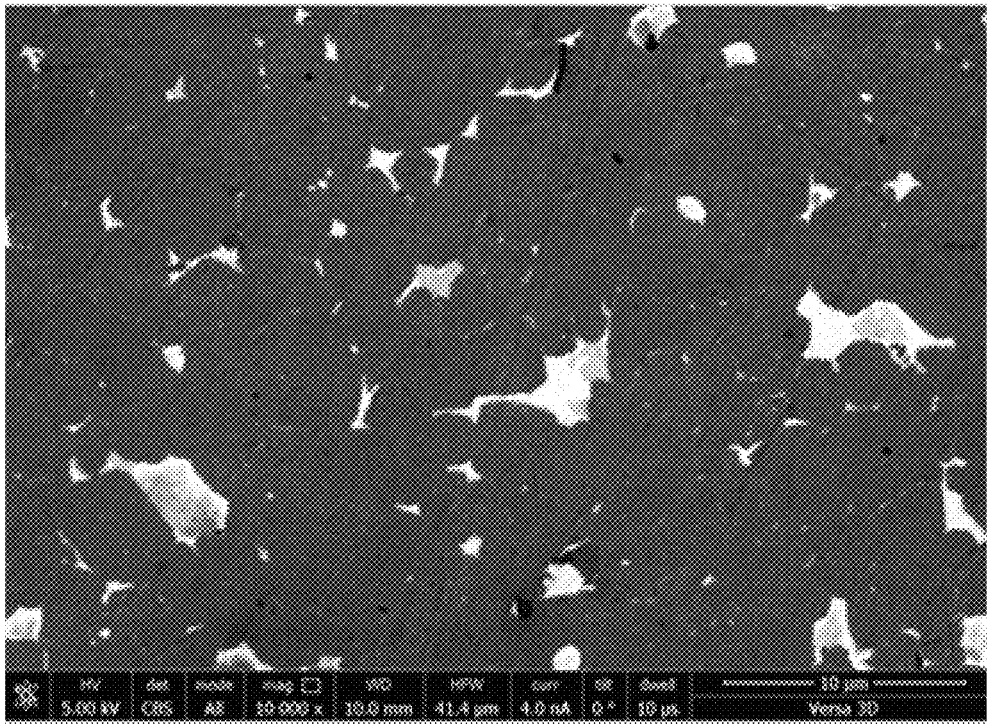
FIGS. 5A and 5B show microstructures of samples prepared from a conventional single alloy method in the related art and an exemplary method of the present invention.
Figure 5B:
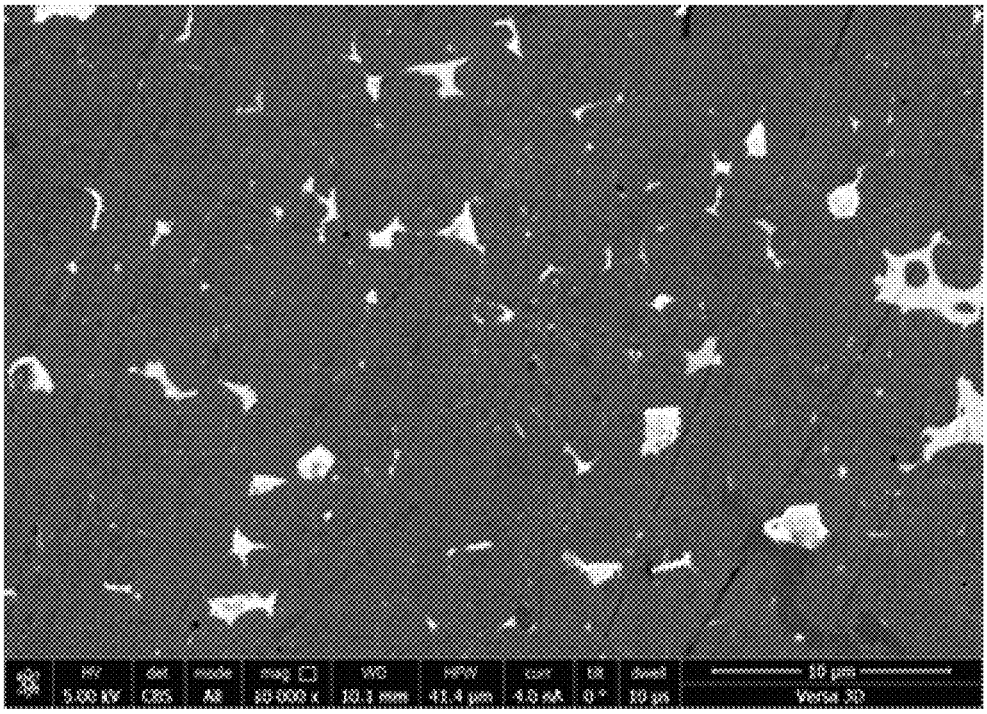

In addition, microstructure photographs of the sample 1-7 and the sample 2-1 of Table 4 were shown in FIGS. 5A and 5B, respectively.

FIGS. 5A and 5B are photographs showing microstructures of samples prepared according to a single alloy method according to the related art and an example of the present invention.

TABLE 3-2

| Sample condition | Residual magnetic flux density, Br(kG): Single alloy method | Residual magnetic flux density, Br(kG): Powder mixing method | Coercive force, Hcj (kOe): Single alloy method | Coercive force, Hcj (kOe): Powder mixing method | Difference (Single-mixing) | Note |
|---|---|---|---|---|---|---|
| 1-1 | 12.91 | 12.91 | 17.7 | 17.7 | 0 | — |
| 1-2 | 12.7 | 12.69 | 17.3 | 15.4 | −1.9 | Coercive force reduction of 1.9 |
| 1-3 | 12.49 | 12.66 | 16.9 | 14.8 | −2.1 | Coercive force reduction of 2.1 |
| 1-4 | 12.12 | 12.29 | 16.1 | 15.2 | −0.9 | Coercive force reduction of 0.9 |
| 1-5 | 11.94 | 12.12 | 15.6 | 15.6 | 0 | — |
| 1-6 | 11.74 | 11.9 | 15.2 | 15.4 | 0.2 | Coercive force increase of 0.2 |
| 1-7 | 11.37 | 11.5 | 14.3 | 14.7 | 0.4 | Coercive force increase of 0.4 |
| 1-8 | 11 | 11 | 13.5 | 13.8 | 0.3 | Coercive force increase of 0.3 |
| 1-9 | 11 | 11 | 11 | 11 | 0 | — |

TABLE 4

| Sample condition | Mixing ratio: First alloy (16% Nd + 12% Ce) | Mixing ratio: Second alloy (28% Nd + 0% Ce) | Content of rare-earth element (total rare-earth element: 28%): Nd | Content of rare-earth element (total rare-earth element: 28%): Ce | Residual magnetic flux density, Br(kG) | Coercive force, Hcj (kOe) | Note |
|---|---|---|---|---|---|---|---|
| 1-7 | 80 | 20 | 18.4 | 9.6 | 11.5 | 14.7 | Excellent |
| 2-1 | Single alloy method according to the related art | | 18.4 | 9.6 | 11.37 | 14.3 | |

As shown in Table 4 and illustrated in FIGS. 5A and 5B, it could be confirmed that the residual magnetic flux density and the coercive force of the sample prepared according to the present invention were excellent as compared to those of the single alloy method according to the related art.

Subsequently, a test was carried out to confirm the effect of performing a heat treatment divided into three steps.

In this case, the heat treatment step was changed as shown in Table 5-1, and measured values of the residual magnetic flux density and the coercive force according to the change were shown in Table 5-2.

TABLE 5-1

| Sample condition | Mixing ratio: First alloy (16% Nd + 12% Ce) | Mixing ratio: Second alloy (28% Nd + 0% Ce) | Content of rare-earth element (total rare-earth element: 28%): Nd | Content of rare-earth element (total rare-earth element: 28%): Ce | Heat treatment temperature (° C.): Primary heat treatment | Heat treatment temperature (° C.): Secondary heat treatment | Heat treatment temperature (° C.): Tertiary heat treatment |
|---|---|---|---|---|---|---|---|
| 1-7 | 80 | 20 | 18.4 | 9.6 | Not performed | 850 | 500 |
| 3-1 | 80 | 20 | 18.4 | 9.6 | Not performed | 750 | 500 |
| 3-2 | 80 | 20 | 18.4 | 9.6 | Not performed | 950 | 500 |
| 3-3 | 80 | 20 | 18.4 | 9.6 | 450 | 850 | 500 |
| 3-4 | 80 | 20 | 18.4 | 9.6 | 550 | 850 | 500 |
| 3-5 | 80 | 20 | 18.4 | 9.6 | 650 | 850 | 500 |
| 3-6 | 80 | 20 | 18.4 | 9.6 | 750 | 850 | 500 |

TABLE 5-2

| Sample condition | Magnetic properties: Residual magnetic flux density, Br(kG) | Magnetic properties: Coercive force, Hcj (kOe) | Difference in coercive force from Sample 1-7 | Note |
|---|---|---|---|---|
| 1-7 | 11.5 | 14.7 | 0 | Reference |
| 3-1 | 11.44 | 14.8 | 0.1 | No effect |
| 3-2 | 11.52 | 14.4 | −0.3 | Property reduction |
| 3-3 | 11.5 | 14.8 | 0.1 | No effect |
| 3-4 | 11.5 | 15.7 | 0 | Improved |
| 3-5 | 11.5 | 16.3 | 1.6 | Best |
| 3-6 | 11.5 | 15.4 | 0.7 | Improved |

As shown in Table 5-2, it could be confirmed that, in the samples 3-1 and 3-2 in which the primary heat treatments were not performed, there was little or no improvement in the coercive force, or the coercive force was rather reduced.

In addition, it could be confirmed that in the sample 3-3 in which the temperature in the primary heat treatment was less than the range suggested in the present invention, there was little or no improvement in the coercive force.

On the other hand, it could be confirmed that in the samples 3-4 to 3-6 in which the temperatures in the primary heat treatment were in the range suggested in the present invention, the coercive force was increased.

Next, magnetic properties and a microstructure according to a mixing ratio of the first alloy in the Ce-rich state to the second alloy in the Ce-less state in which the Ce content was relatively small were investigated.

In this case, the mixing ratio of the first alloy to the second alloy was changed as shown in Table 6-1, and measured values of the residual magnetic flux density and the coercive force according to the change were shown in Table 6-2.

Meanwhile, in order to compare a sample in which the first alloy and the second alloy are mixed with each other according to the example of the present invention and a sample formed by a single alloy method, a residual magnetic flux density and a coercive force of each sample having the same composition and prepared by the single alloy method were measured. The results are shown in Table 6-2.

TABLE 6-1

| Sample condition | Mixing ratio: First alloy (16% Nd + 12% Ce) | Mixing ratio: Second alloy (28% Nd + 0% Ce) | Content of rare-earth element (total rare-earth element: 28%): Nd | Content of rare-earth element (total rare-earth element: 28%): Ce |
|---|---|---|---|---|
| 4-1 | 0 | 100 | 22 | 6 |
| 4-2 | 10 | 90 | 21.4 | 6.6 |
| 4-3 | 20 | 80 | 20.8 | 7.2 |
| 4-4 | 40 | 60 | 19.6 | 8.4 |
| 4-5 | 50 | 50 | 19 | 9 |
| 4-6 | 60 | 40 | 18.4 | 9.6 |
| 4-7 | 80 | 20 | 17.2 | 10.8 |
| 4-8 | 90 | 10 | 16.6 | 11.4 |
| 4-9 | 100 | 0 | 16 | 12 |

TABLE 6-2

| Sample condition | Residual magnetic flux density, Br(kG) Single alloy method | Residual magnetic flux density, Br(kG) Powder mixing method | Coercive force, Hcj (kOe) Single alloy method | Coercive force, Hcj (kOe) Powder mixing method | Difference (Single-mixing) | Note |
|---|---|---|---|---|---|---|
| 4-1 | 11.94 | 12.11 | 15.6 | 15.6 | 0 | — |
| 4-2 | 11.87 | 11.99 | 15.4 | 14.5 | −0.9 | Coercive force reduction of 0.9 |
| 4-3 | 11.74 | 11.83 | 15.2 | 14.1 | −1.1 | Coercive force reduction of 2.1 |
| 4-4 | 11.56 | 11.72 | 15 | 14.5 | −0.5 | Coercive force reduction of 0.9 |
| 4-5 | 11.44 | 11.39 | 14.7 | 14.7 | 0 | — |
| 4-6 | 11.37 | 11.45 | 14.3 | 14.6 | 0.3 | Coercive force increase of 0.3 |
| 4-7 | 11 | 11.19 | 13.5 | 14.1 | 0.6 | Coercive force increase of 0.6 |
| 4-8 | 10.76 | 10.86 | 12.4 | 12.7 | 0.3 | Coercive force increase of 0.3 |
| 4-9 | 11 | 11 | 11 | 11 | 0 | — |

As shown in Table 6-2, it could be confirmed that the coercive force was increased as compared to the single alloy method in a range in which the Ce content in the first alloy in the Ce-rich state is 50 wt % or greater.

On the other hand, it could be confirmed that the coercive force was reduced as compared to the single alloy method in a range in which the Ce content in the first alloy in the Ce-rich state is less than 50 wt %.

Next, magnetic properties and microstructures of a sample manufactured by the single alloy method according to the related art and a sample according to the present invention were investigated.

In this case, a condition of each sample and measured values of a residual magnetic flux density and a coercive force of each sample were shown in Table 7.

TABLE 7

| Sample condition | Mixing ratio First alloy (16% Nd + 12% Ce) | Mixing ratio Second alloy (28% Nd + 0% Ce) | Content of rare-earth element (total rare-earth element: 28%) Nd | Content of rare-earth element (total rare-earth element: 28%) Ce | Residual magnetic flux density, Br(kG) | Coercive force, Hcj (kOe) | Note |
|---|---|---|---|---|---|---|---|
| 4-7 | 80 | 20 | 17.2 | 10.8 | 11.19 | 14.1 | Excellent |
| 5-1 | Single alloy method according to the related art | | 17.2 | 10.8 | 11 | 13.5 | |

As shown in Table 7, it could be confirmed that the residual magnetic flux density and the coercive force of the sample prepared according to the present invention were excellent as compared to those of the single alloy method according to the related art.

Subsequently, a test was carried out to confirm the effect of performing a heat treatment divided into three steps.

In this case, the heat treatment step was changed as shown in Table 8-1, and measured values of the residual magnetic flux density and the coercive force according to the change were shown in Table 8-2.

TABLE 8-1

| Sample condition | Mixing ratio: First alloy (16% Nd + 12% Ce) | Mixing ratio: Second alloy (28% Nd + 0% Ce) | Content of rare-earth element (total rare-earth element: 28%): Nd | Content of rare-earth element (total rare-earth element: 28%): Ce | Heat treatment temperature (° C.): Primary heat treatment | Heat treatment temperature (° C.): Secondary heat treatment | Heat treatment temperature (° C.): Tertiary heat treatment |
|---|---|---|---|---|---|---|---|
| 4-7 | 80 | 20 | 17.2 | 10.8 | Not performed | 850 | 500 |
| 6-1 | 80 | 20 | 17.2 | 10.8 | Not performed | 750 | 500 |
| 6-2 | 80 | 20 | 17.2 | 10.8 | Not performed | 950 | 500 |
| 6-3 | 80 | 20 | 17.2 | 10.8 | 450 | 850 | 500 |
| 6-4 | 80 | 20 | 17.2 | 10.8 | 550 | 850 | 500 |
| 6-5 | 80 | 20 | 17.2 | 10.8 | 650 | 850 | 500 |
| 6-6 | 80 | 20 | 17.2 | 10.8 | 750 | 850 | 500 |

TABLE 8-2

| Sample condition | Magnetic properties: Residual magnetic flux density, Br(kG) | Magnetic properties: Coercive force, Hcj (kOe) | Difference in coercive force from Sample 1-7 | Note |
|---|---|---|---|---|
| 4-7 | 11.19 | 14.1 | — | Reference |
| 6-1 | 11.44 | 14.2 | 0.1 | No effect |
| 6-2 | 11.52 | 13.9 | −0.3 | Property reduction |
| 6-3 | 11.5 | 14 | 0.1 | No effect |
| 6-4 | 11.5 | 14.5 | 0.5 | Improved |
| 6-5 | 11.5 | 15.3 | 0.8 | Best |
| 6-6 | 11.5 | 15.6 | 0.3 | Improved |

As shown in Table 8-2, it could be confirmed that, in the samples 6-1 and 6-2 in which the primary heat treatments were not performed, there was little or no improvement in the coercive force, or the coercive force was rather reduced.

In addition, it could be confirmed that in the sample 6-3 in which the temperature in the primary heat treatment was less than the range suggested in the present invention, there was little or no improvement in the coercive force.

On the other hand, it could be confirmed that in the samples 6-4 to 6-6 in which the temperatures in the primary heat treatment were in the range suggested in the present invention, the coercive force was increased.

According to various exemplary embodiments of the present invention, the permanent magnet can be manufactured by using Ce cost-competitive to Nd and mixing different powders obtained by classifying a magnetic powder containing Ce into a magnetic powder in a Ce-rich state and a magnetic powder in a Ce-less state, such that a manufacturing cost of the permanent magnet may be reduced, and magnetic properties of the permanent magnet may be improved.

Although the present invention has been described with reference to the accompanying drawings and the preferred embodiments described above, the present invention is not limited thereto but is defined by the claims to be described below. Therefore, those skilled in the art will appreciate that various modifications and changes are possible, without departing from the technical spirit of the claims to be described below.

What is claimed is:

1. A method of manufacturing a rare-earth permanent magnet, comprising:

preparing a mixed powder comprising: a first alloy represented by $R1_aR2_bB_cM_dFe_{bal}$, where R1 is one or two or more of La, Ce, and Y, R2 is a rare-earth element except for La, Ce, and Y; M is a metal element but excludes rare earth metal elements and Fe; a+b is 29 to 34 wt %; a/(a+b) is 30 to 100%; c is 0.8 to 1.5 wt %; and d is 0.1 to 5.0 wt %, wt % based on the total weight of the first alloy; and a second alloy represented by $R2_{b'}B_{c'}M_{d'}Fe_{bal}$ where R2 is a rare-earth element except for La, Ce; and Y; M is a metal element but excludes rare earth metal elements and Fe; b' is 29 to 34 wt %; c' is 0.8 to 1.5 wt %; and d' is 0.1 to 5.0 wt %, wt % based on the total weight of the second alloy;

sintering the prepared mixed powder in a magnetic field to prepare a sintered body; and performing a heat treatment based on diffusion temperature conditions of an R1 component and an R2 component contained in the prepared sintered body, wherein the heat treatment is performed by the steps comprising:

performing a primary heat treatment at a diffusion temperature of the R1 component contained in the prepared sintered body;

performing a secondary heat treatment at a diffusion temperature of the R2 component contained in the sintered body subjected to the primary heat treatment; and performing a tertiary heat treatment for arranging atomic lattices of components constituting the sintered body subjected to the secondary heat treatment, wherein the primary heat treatment is performed in a temperature range of 550 to 750° C., followed by a cooling step, the secondary heat treatment is performed in a temperature range of 750 to 950° C., and the tertiary heat treatment is performed in a temperature range of 450 to 550° C.

2. The method of claim 1, wherein, in the first alloy, R1 is at least 70 wt % of Ce.

3. The method of claim 1, wherein, in the first alloy or the second alloy, M comprises one or two or more elements selected from the group consisting of Co, Ni, Cu, Zn, Al, Ga, Ti, V, Cr, Mn, Zr, Nb, Mo, Hf, Ta, and W.

4. The method of claim 1, wherein, the mixed powder is prepared by the steps comprising:

preparing, respectively, a first strip by melting and then cooling the first alloy and a second strip by melting and then cooling the second alloy;

preparing, respectively, a first treated powder by hydrogenating, dehydrogenating, and jet-mill-treating the prepared first strip and a second treated powder by hydrogenating, dehydrogenating, and jet-mill-treating the prepared second strip; and preparing the mixed powder including the prepared first treated powder and second treated powder.

5. The method of claim 4, wherein the mixed powder comprises the first treated powder and the second treated powder mixed at a weight ratio of 50:50 to 90:10.

6. The method of claim 1, wherein, the mixed powder is prepared by the steps comprising:

preparing, respectively, a first strip by melting and then cooling the first alloy and a second strip by melting and then cooling the second alloy;

preparing a mixed strip including the first strip and the second strip; and preparing a mixed powder by hydrogenating, dehydrogenating, and jet-mill-treating the prepared mixed strip.

7. The method of claim 6, wherein a mixed strip comprises the first strip and the second strip mixed at a weight ratio of about 50:50 to 90:10.

8. The method of claim 1, wherein each of the primary heat treatment, the secondary heat treatment, and the tertiary heat treatment is performed for 0.1 to 20 hours.

9. The method of claim 1, wherein the heat treatment is performed by the steps further comprising:

cooling the sintered body subjected to the primary heat treatment after the primary heat treatment;

cooling the sintered body subjected to the secondary heat treatment after the secondary heat treatment; and cooling the sintered body subjected to the tertiary heat treatment after the tertiary heat treatment.

10. The method of claim 9, wherein each of the primary cooling, the secondary cooling, and the tertiary cooling is performed at a cooling rate of 2 to 20° C./s.

11. A method of manufacturing a rare-earth permanent magnet, comprising:

preparing a mixed powder comprising i) a first alloy represented by $R1_aR2_bB_cM_dFe_{bal}$ where R1 is one or two or more of La, Ce, and Y; R2 is a rare-earth element except for La, Ce, and Y; M is a metal element but excludes rare earth metal elements and Fe; a+b is 29 to 34 wt %; a/(a+b) is 30 to 100%; c is 0.8 to 1.5 wt %; and d is 0.1 to 5.0 wt %, wt % based on the total weight of the first alloy, and ii) a second alloy represented by $R1_{a'}R2_{b'}B_{c'}M_{d'}Fe_{bal}$ where R1 is one or two or more of La, Ce, and Y; R2 is a rare-earth element except for La, Ce, and Y; M is a metal element but excludes rare earth metal elements and Fe, a'+b' is 29 to 34 wt %; a'/(a'+b') is 0 to 30% (excluding 0%); c' is 0.8 to 1.5 wt %; and d' is 0.1 to 5.0 wt %, wt % based on the total weight of the second alloy, wherein the second alloy does not include Ce;

sintering the prepared mixed powder in a magnetic field to prepare a sintered body; and performing a heat treatment based on diffusion temperature conditions of an R1 component and an R2 component contained in the prepared sintered body;

wherein the heat treatment is performed by the steps comprising:

performing a primary heat treatment at a diffusion temperature of the R1 component contained in the prepared sintered body, performing a secondary heat treatment at a diffusion temperature of the R2 component contained in the sintered body subjected to the primary heat treatment; and performing a tertiary heat treatment for arranging atomic lattices of components constituting the sintered body subjected to the secondary heat treatment, wherein the primary heat treatment is performed in a temperature range of 550 to 750° C., the secondary heat treatment is performed in a temperature range of 750 to 950° C., and the tertiary heat treatment is performed in a temperature range of 450 to 550° C.

12. The method of claim 11, wherein each of the primary heat treatment, the secondary heat treatment, and the tertiary heat treatment is performed for 0.1 to 20 hours.

* * * * *